United States Patent [19]

Thome

[11] 4,316,717

[45] Feb. 23, 1982

[54] METHOD OF CONTROLLING STRIP TEMPERATURES

[75] Inventor: William L. Thome, Toledo, Ohio

[73] Assignee: Midland-Ross Corporation, Cleveland, Ohio

[21] Appl. No.: 200,775

[22] Filed: Oct. 27, 1980

[51] Int. Cl.[3] ..... F27B 9/28; C21D 9/52

[52] U.S. Cl. ..... 432/8; 266/102

[58] Field of Search ..... 432/8, 59; 266/102, 266/103, 105, 106

[56] References Cited

U.S. PATENT DOCUMENTS 3,252,693 5/1966 Nelson ..... 266/103 X 4,239,483 12/1980 Iida et al. ..... 266/103 X

*Primary Examiner*—John J. Camby

*Attorney, Agent, or Firm*—Harlan E. Hummer

[57] ABSTRACT

A method of controlling strip temperatures of two joined metal strips of dissimilar gauges but requiring essentially the same heat treatment temperatures, is described. The normal processing temperature is higher than the temperature to which it is desired to heat the webs. The higher processing temperature is reduced to a lower temperature in response to a change in the gauge of the webs passing through the chamber in which the webs are heat treated. This lower temperature is such that the heavier gauge web will not be underheated and the lighter gauge web will not be overheated. The line speed at which the juncture of the webs passes through the chamber will simultaneously be lowered in correlated relation to the reduction of the temperature within the heat treatment chamber until such time as the juncture passes from the chamber so that the processing conditions of time and temperature can be readjusted to accommodate heat treatment of the new web.

8 Claims, 2 Drawing Figures

METHOD OF CONTROLLING STRIP TEMPERATURES

BACKGROUND OF THE INVENTION

The invention is applicable in the heat treatment of any suitable traveling web, and is especially useful in the annealing of long, continuous strips or sheets of aluminum or steel.

Those skilled in the art realize that the most economical method of annealing involves the processing of identical gauge materials which require about the same annealing temperatures. Unfortunately, this is not always possible. The next most economical method involves the continuous annealing of different gauge materials which require about the same annealing temperatures, since it is simpler and more energy efficient to adjust the line speeds at which the material is annealed, rather than radically alter or fluctuate the temperature within the annealing furnace. It is, therefore, not uncommon to attach to the trailing end of a strip of metal, the leading end of a strip of metal having a heavier or lighter gauge.

It is also well known that the processing temperatures in an annealing furnace are maintained higher than the temperature to which a strip of metal is desired to be heated to generally speed up the annealing process. For example, the annealing furnace may be maintained at a temperature of about 1600° F., when it is desired to heat a strip of metal to a temperature of about 1450° F. In the aforementioned example, it can be appreciated that, if the time/temperature processing conditions are maintained between two joined metal strips of dissimilar gauges, then the beginning portion of the second or trailing metal strip will be improperly treated until the first or leading metal strip exits the furnace and the processing conditions can be adjusted to accommodate the different gauge of the second metal strip. Under such conditions, a thousand feet of the second metal strip may be wasted, because of the high line speeds at which the metal strip is moved through the annealing furnace.

This problem is oftentimes solved by using a dummy coil or strip of metal that is attached to the trailing end of the first strip of metal. The dummy strip is considered wasted material and is reused many times in such operations to gain time to allow the exodus of the first metal strip from the annealing furnace and subsequent adjustment of the line speed to accommodate the gauge of the second metal strip which is fastened to the trailing end of the dummy strip. This particular method works, but is uneconomical, since considerable time is lost in the annealing of the dummy strip. The invention is designed to overcome this problem by maximizing the annealing of metal strip while minimizing the waste of metal strip caused by improper heat treatment.

Briefly stated, the invention is in a method of controlling the temperatures of two continuous traveling webs which are joined together, require essentially the same heat treatment temperatures, and are of gauges sufficiently different to affect the time of treatment. The leading and trailing ends of these two webs are joined together by any suitable means. The processing temperature is reduced from a normally higher processing level to a desired lower level when the juncture of the two webs enters the chamber in which the heat treatment process of the webs is carried out, the lower temperature level being such that both webs will be properly heated. The line speed at which the webs travel through the heat treatment chamber is slowed down in accordance with the reduction in the processing temperature.

Once the leading web is free of the chamber, then the processing conditions can be readjusted to accommodate the new gauge of the trailing web. Thus, it can be appreciated that no web should be wasted because of overheating, as the annealing process is maintained continuous.

DESCRIPTION OF THE DRAWING

The following description of the invention will be better understood by having reference to the accompanying drawing, wherein.

ENVIRONMENT OF THE INVENTION

Figure 1:
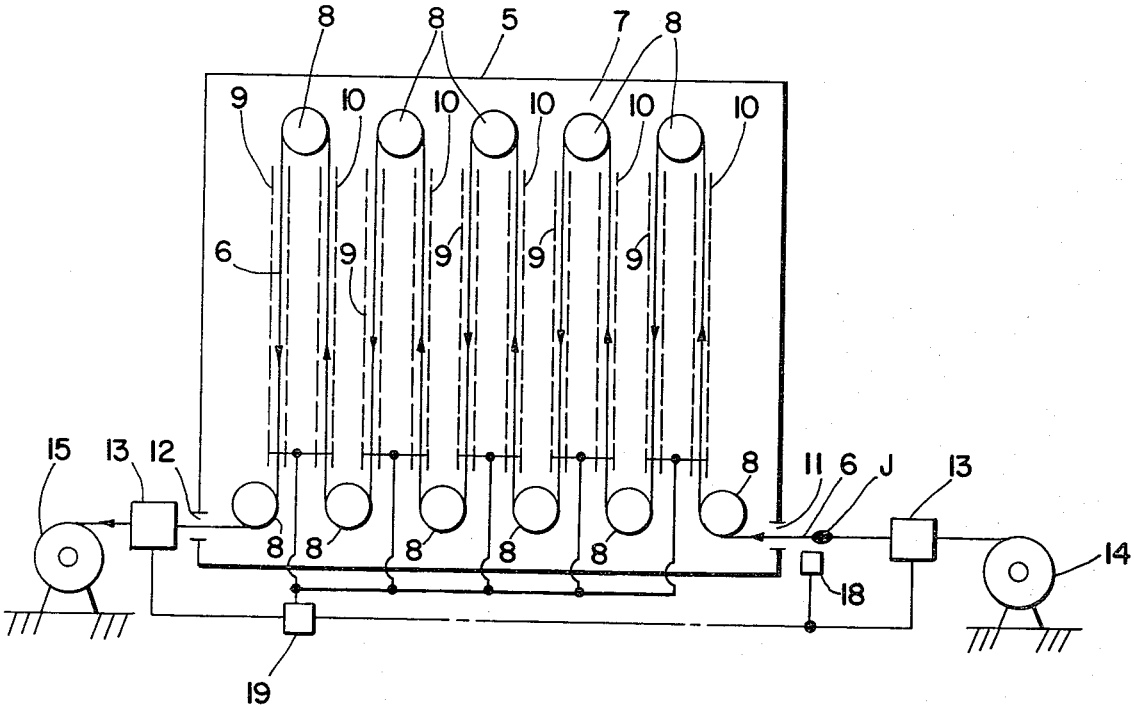
FIG. 1 is a longitudinal cross-sectional schematic view of an annealing furnace which is made in accordance with the invention.
Figure 2:
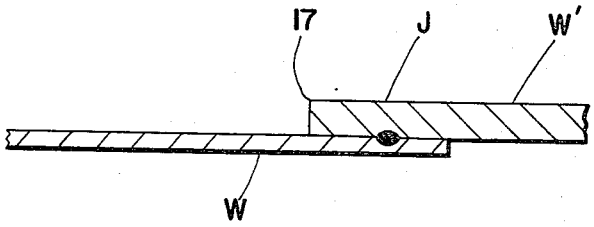
FIG. 2 is an enlarged section of the juncture of two metal plates of different gauges.

With reference to the drawing, there is shown a furnace 5 in which a continuous web 6, such as a strip or sheet of aluminum or steel material, is annealed. The furnace 5 comprises a chamber 7 which is sealed from the ambient atmosphere. A plurality of similar rollers 8 are strategically located within the chamber 7 to guide the web 6 in a zig-zag, wave-like pathway between opposing banks of, for example, conventional radiant tube heaters 9,10 used in the heat treatment or annealing of the web 6. The furnace 5 is provided with an entrance opening 11 and an exit opening 12 through which the web 6 enters and exits the chamber 7. Any suitable means, e.g. bridle rolls 13 are provided to pull the web 6 from a letoff 14 through the chamber 7 at a predetermined, desired line speed, onto a coiling or windup device 15.

As previously indicated, it is desireable to make the annealing process as continuous as possible. Therefore, it is most desireable to process together similar webs of like gauges requiring essentially the same processing temperature. Since this is not always possible, the next most economical annealing process is achieved by annealing differently gauged webs that require substantially the same heat treatment or annealing temperature. The invention is concerned with the latter process.

THE INVENTION

The trailing end 16 of the leading web W being processed is secured to the leading end 17 of the trailing web W', next to be processed, by any suitable means, e.g. continuous spot welding, to form a juncture J therebetween.

Any appropriate mechanism 18 is provided outside the chamber 7 adjacent the entrance opening 11 to sense the approach of the welded juncture J of the joined webs W,W'. The sensing mechanism 18, upon perception of the welded juncture J, triggers any suitable device 19 which coacts with the heaters 9, 10 and bridle rolls 13, as schematically shown, to cause (I) a turndown of the heaters by, for example, stopping circulation of heated gas through the tubes of the radiant tube heaters, and (II) a slow down of the rotation of the bridle rolls, to correspondingly cause (I) lowering of the temperature within the chamber 7 from the normally higher processing temperature to a temperature where the heavier gauge web will not be under heated and the lighter gauge web will not be overheated, and (II) a corresponding reduction in the line speed, at which the webs travel through the chamber 5 until the juncture of the webs exits the chamber 7 so that the temperature and line speed can be readjusted to optimize the heat treatment of the new web.

The lower temperature to which the chamber is reduced, is dependent on the allowable temperature variance from a desired norm. If, for example, the variance is plus or minus zero degrees, then the normal processing temperature would be reduced to the actual temperature to which it is desired to heat the webs. If there is a variance, the normal processing temperature would be lowered to fall within the maximum and minimum temperature limitations. In any case, the line speed is normally slowed down to adjust or compensate for the decrease in the processing temperature.

Thus, there has been described a unique method and mechanism wherein the line speed, or rate at which webs of different gauges are heat treated, is optimized without adversely affecting the quality of the webs being heat treated.

What is claimed is:

1. A method of heat treating a pair of joined webs, such as strips or sheets of metal, of dissimilar gauges that require about the same heat treatment temperatures, comprising the steps of:

(a) successively passing the joined webs through a chamber which is heated to a normal processing temperature which is higher than the temperature to which the webs are desired to be heated;

(b) sensing the approach of the juncture outside the chamber, prior to entry of the juncture into the chamber;

(c) reducing the temperature within the chamber from the normal processing temperature to a temperature which is not lower than the temperature to which the webs are desired to be heated, when the juncture is sensed; and (d) simultaneously reducing the line speed at which the juncture of the webs passes through the chamber in correlated relation to the reduction of the temperature within the chamber.

2. The method of claim 1, which includes reducing the temperature in the chamber to a temperature which is in the range of maximum and minimum allowable temperatures to which the webs can be heated.

3. The method of claim 1, wherein the time and temperature of the heat treatment of the pair of webs during reduction of the temperature within the chamber is such that the lighter gauge web will not be overheated and the heavier gauge web will not be underheated.

4. The method of claims 1, 2, or 3 used in the annealing of metal strip material.

5. A device for controlling the temperature of a pair of joined webs of dissimilar gauges that require about the same heat treatment temperature in a chamber which is heated to a normal processing temperature which is higher than the desired heat treatment temperature, comprising:

(a) means for sensing the juncture of the pair of webs outside the chamber and prior to entry of the juncture into the chamber;

(b) means for reducing the temperature in the chamber from the normal processing temperature to a temperature which is not lower than the temperature to which the webs are desired to be heated, when the juncture of the pair of webs is sensed; and (c) means for simultaneously slowing the line speed at which the juncture of the pair of webs moves through the chamber when the temperature is reduced.

6. The device of claim 5, wherein the line speed slowing means includes means for decreasing the line speed of the juncture in correlated relation to the reduction of the temperature.

7. The device of claim 6, wherein the temperature reducing means includes means for lowering the temperature such that the heavier gauge web will not be underheated and the lighter material will not be overheated.

8. The device of claim 6, wherein the temperature reducing means includes means for lowering the temperature to a temperature which is in the range of maximum and minimum allowable temperatures to which the webs can be heated.

* * * * *